US009880497B2

(12) United States Patent
Sakamoto et al.

(10) Patent No.: US 9,880,497 B2
(45) Date of Patent: Jan. 30, 2018

(54) IMAGE FORMING DEVICE, POSITION SHIFT CORRECTION METHOD, AND RECORDING MEDIUM

(71) Applicants: Junshin Sakamoto, Kanagawa (JP); Kenji Sugiura, Kanagawa (JP)

(72) Inventors: Junshin Sakamoto, Kanagawa (JP); Kenji Sugiura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/455,518

(22) Filed: Mar. 10, 2017

(65) Prior Publication Data

US 2017/0269516 A1 Sep. 21, 2017

(30) Foreign Application Priority Data

Mar. 16, 2016 (JP) ..... 2016-052001

(51) Int. Cl.
*G03G 15/16* (2006.01)

(52) U.S. Cl.
CPC ..... *G03G 15/1665* (2013.01)

(58) Field of Classification Search
CPC ..... G03G 15/1665; G03G 15/1675; G03G 2215/0158; G03G 2215/0161
See application file for complete search history.

(56) References Cited

U.S. PATENT DOCUMENTS

| | | | | |
|---|---|---|---|---|
| 8,335,446 | B2 * | 12/2012 | Kobayashi | G03G 15/0178 399/301 |
| 2012/0321356 | A1 | 12/2012 | Sakamoto | |
| 2015/0037054 | A1 | 2/2015 | Nagata et al. | |
| 2016/0109832 | A1 | 4/2016 | Ohsugi et al. | |
| 2016/0139528 | A1 | 5/2016 | Sakamoto | |
| 2016/0274503 | A1 | 9/2016 | Sugiura et al. | |
| 2016/0274504 | A1 | 9/2016 | Wada et al. | |
| 2016/0334738 | A1 | 11/2016 | Kochi et al. | |
| 2016/0334739 | A1 | 11/2016 | Ohsugi et al. | |
| 2017/0031289 | A1 * | 2/2017 | Itagaki | G03G 15/5058 |

FOREIGN PATENT DOCUMENTS

JP 2014-178385 9/2014

* cited by examiner

*Primary Examiner* — Gregory H Curran
(74) *Attorney, Agent, or Firm* — Harness, Dickey & Pierce, P.L.C.

(57) ABSTRACT

An image forming device includes a plurality of image formation units each configured to form an image of one of a plurality of colors, and a patch image transfer unit configured to control transfer conditions during transferring a patch group that is a pattern for detecting a position shift and formed on an intermediate transfer belt onto a secondary transfer belt. The patch image transfer unit is configured to transfer patches of at least single color for which a band of transfer efficiency is narrowest, of the patch group, onto the secondary transfer belt under transfer conditions for the color, and during transition to the transfer conditions for the color from other transfer conditions or during transition from the transfer conditions for the color to the other transfer conditions, patches of a color other than the color, of the patch group is transferred onto the secondary transfer belt.

7 Claims, 4 Drawing Sheets

IMAGE FORMING DEVICE, POSITION SHIFT CORRECTION METHOD, AND RECORDING MEDIUM

CROSS-REFERENCE TO RELATED APPLICATIONS

The present application claims priority under 35 U.S.C. §119 to Japanese Patent Application No. 2016-052001, filed Mar. 16, 2016. The contents of which are incorporated herein by reference in their entirety.

BACKGROUND OF THE INVENTION

1. Field of the Invention

The present invention relates to an image forming device, a position shift correction method, and a recording medium.

2. Description of the Related Art

In the related art, a color image forming device such as a laser printer includes a color image forming device of a tandem system in which an image of each color formed by a unit of each of the colors is superimposed on an intermediate transfer belt, and then, the image on the intermediate transfer belt is transferred onto a sheet.

In such a color image forming device of a tandem system, resist correction processing of accurately matching an image position of each of the colors is performed. For example, in the resist correction processing, the color image forming device forms an image of a patch pattern (hereinafter, referred to as a "patch image") such as an oblique line or a horizontal line for detecting a shift of a transfer position in a main scanning direction and a sub-scanning direction on the transfer belt for each of the colors. After that, in the resist correction processing, the color image forming device reads the interval between the respective patch images to calculate a color shift correction amount, and corrects a color shift in the main scanning direction and the sub-scanning direction of each of the colors.

Recently, in the color image forming device of the tandem system, there is a case where an intermediate transfer belt of an elastic body (hereinafter, referred to as an "elastic belt") is used in order to respond to various recording media (for example, uneven paper and the like). Regular reflection light extremely decreases on such an elastic belt. For this reason, in a patch image detection system using regular reflection, a secondary transfer belt using a material from which regular reflection light can be obtained is also used in addition to the elastic belt. That is, in a case where the elastic belt and the secondary transfer belt are used, the color image forming device transfers the patch image which is transferred onto the elastic belt to the secondary transfer belt, and reads the patch image on the secondary transfer belt by a regular reflection sensor.

When a color image is transferred onto the secondary transfer belt as described above (secondary transfer), in the color image forming device of the tandem system, the patch image is transferred onto the secondary transfer belt in optimal conditions (a transfer voltage or a transfer current) at the time of printing the color image, in consideration of superimposing color images of at least two or more colors.

Here, the patch image of each of the colors formed on the intermediate transfer belt is transferred in optimal primary transfer conditions in each of the colors, and thus, is accurately transferred onto the intermediate transfer belt.

In contrast, in the secondary transfer, the transfer of the patch image is set in the optimal conditions as the color image, and thus, there is a case where the transfer of the patch image on the secondary transfer belt is not optimal according to the shape or the color of the patch image. In such a case, there is a problem in which the transfer onto the secondary transfer belt is insufficient, and a variation or a deviation occurs in an adhesion amount of a toner or an ink. In particular, such a problem is remarkable with respect to a black color.

Thus, in a case where the variation or the deviation occurs in the adhesion amount, the output sensed by the regular reflection sensor becomes unstable, or the phase of the output sensed by the regular reflection sensor is shifted. The unstable output or the phase shift becomes an error in reading the interval between the patch images, and thus, it is not possible to detect an accurate position shift. Thus, in a case where the accurate position shift is not capable of being detected, the color image forming device of the tandem system sets an incorrect adjustment value, and thus, there is a problem in which color matching is not capable of being performed.

SUMMARY OF THE INVENTION

According to one aspect of the present invention, an image forming device includes a plurality of image formation units, an intermediate transfer belt, a secondary transfer belt, a reflection sensor, a pattern forming unit, a patch image transfer unit, and a position shift correction unit. The plurality of image formation units are each configured to form an image of one of a plurality of colors. The intermediate transfer belt is configured such that images of the plurality of colors formed by the image formation units are transferred onto the intermediate transfer belt such that the images are superimposed. The secondary transfer belt is configured to convey a recording medium onto which the images of the plurality of colors formed on the intermediate transfer belt are to be collectively transferred. The reflection sensor is configured to receive reflection light with respect to the secondary transfer belt. The pattern forming unit is configured to form a patch group which is a pattern for detecting a position shift and includes a plurality of patches arranged at regular intervals, with the image formation units, and transfer the patch group onto the intermediate transfer belt. The patch image transfer unit is configured to control transfer conditions relating to transfer bias during transferring the patch group formed on the intermediate transfer belt onto the secondary transfer belt. The position shift correction unit is configured to detect the patch group transferred onto the secondary transfer belt with the reflection sensor, and correct position shifts in each of the plurality of colors in a main scanning direction and a sub-scanning direction. The patch image transfer unit is configured to transfer patches of at least single color for which a band of transfer efficiency is narrowest, of the patch group, onto the secondary transfer belt under transfer conditions for the color for which the band is narrow. During transition to the transfer conditions for the color for which the band is narrow, from other transfer conditions or during transition from the transfer conditions for the color for which the band is narrow, to the other transfer conditions, patches of a color other than the color for which the band is narrow, of the patch group is transferred onto the secondary transfer belt.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
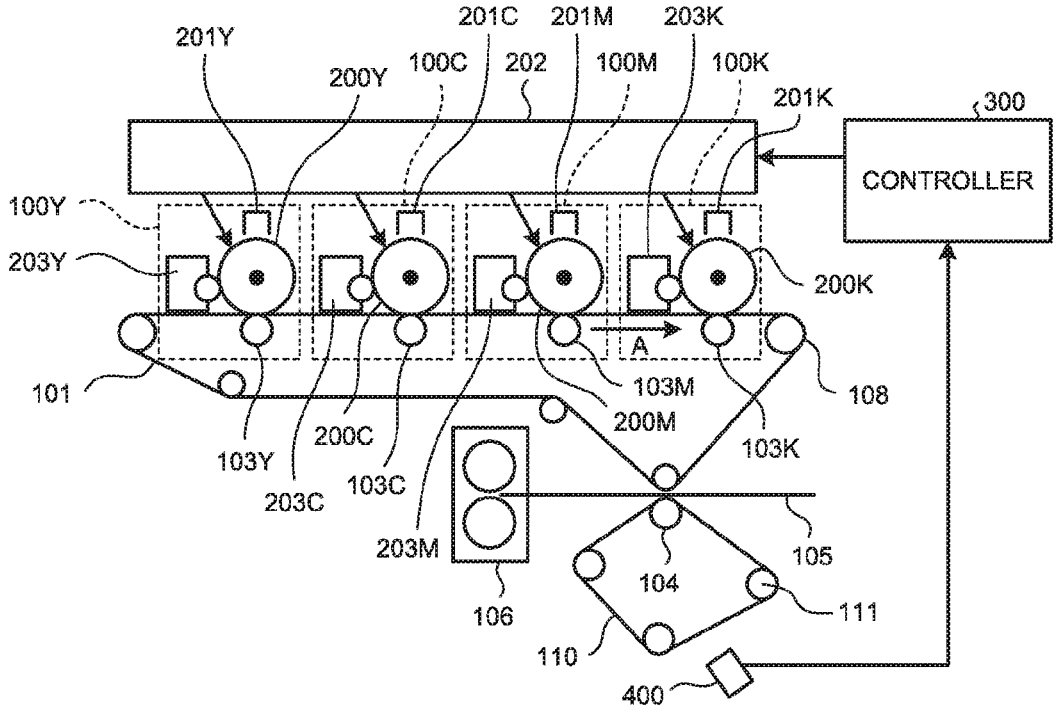
FIG. 1 is a block diagram illustrating a configuration of a printer according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Hereinafter, embodiments of an image forming device, a position shift correction method, and a recording medium will be described in detail with reference to the attached drawings. This embodiment will be described using a color laser printer of a tandem system in which a Carlson process (an electrophotography process) is used as the image forming device, as an example.

An embodiment has an object to provide an image forming device, a position shift correction method, and a recording medium with which a detection error of the interval between patch images on a secondary transfer belt can be reduced, and an excellent color image having a small color shift or a small color matching variation can be obtained.

FIG. 1 is a block diagram illustrating a configuration of a printer 1 according to an embodiment. As illustrated in FIG. 1, the printer 1 is the color laser printer of the tandem system using the electrophotography process.

As illustrated in FIG. 1, in the printer 1, image formation units 100K to 100Y each forming an image of one of color materials (toners) of black (K), magenta (M), cyan (C), and yellow (Y) are arranged side by side along an intermediate transfer belt 101.

Each of the image formation units 100 (100K to 100Y) includes a photoconductor drum 200 (200K to 200Y), a charging device 201 (201K to 201Y), a developing device 203 (203K to 203Y) and a cleaning device. In the following embodiment, at the time of describing each of units having the same function and the same configuration between the respective colors, the units will be described using reference numerals from which "K", "Y", "C", and, "M" are suitably omitted.

The image formation unit 100 forms a color toner image on each of the photoconductor drums 200 through a set of electrophotography processes. Each of the image formation units 100 forms a patch group 404 (refer to FIG. 3) which is a toner image pattern (a patch image (also referred to as a "patch")) for detecting a position shift described below.

Hereinafter, the electrophotography process of the image formation unit 100 will be simply described.

An electrostatic charge is evenly applied to the photoconductor drum 200 by charging with a charging device 201. A multibeam light scanning device 202 converts a signal which is transmitted as color image data of each of the colors into a writing signal, and allows image light (laser light) for recording each of the colors to exit to each of the photoconductor drum 200. Thus, the upper portion of the photoconductor drum 200 is exposed by the image light (the laser light), and thus, an electrostatic latent image according to the color image data of each of the colors is formed on the photoconductor drum 200.

The developing device 203 develops the electrostatic latent image formed on the photoconductor drum 200. The developing device 203, for example, includes a developing sleeve, a developer supply roller, a regulation blade, and the like.

As illustrated in FIG. 1, the printer 1 includes the intermediate transfer belt 101, a primary transfer charger 103 (103K to 103Y), a secondary transfer unit 104, a fixing device 106, a controller 300, and the like.

The intermediate transfer belt 101 is disposed between the photoconductor drum 200 and the primary transfer charger (may be configured of a transfer roller) 103 (103K to 103Y). The intermediate transfer belt 101 is stretched in a plurality of rollers including a driving roller 108 which is rotationally driven by a driving unit. The intermediate transfer belt 101 moves the immediately lower portion of each of the photoconductor drums 200 in the direction of an arrow A according to the rotation driving of the driving roller 108. A movement direction A is set to a sub-scanning direction (y), and a width direction of a sheet 105, which is orthogonal to the sub-scanning direction, is set to a main scanning direction (x).

The primary transfer charger 103 applies a transfer bias to the intermediate transfer belt 101, and transfers the electrostatic latent image which is developed on the photoconductor drum 200 onto the intermediate transfer belt 101.

Accordingly, the electrostatic latent image of each of the colors (the color toner image) which is developed on the photoconductor drum 200 by each of the image formation units 100 is transferred in the same position of the intermediate transfer belt 101 by the primary transfer charger 103 such that the images are superimposed, in the order of Y, C, M, and K.

In this embodiment, in order to improve responsiveness with respect to various recording media (for example, uneven paper and the like), an elastic (rubber) belt is used for the intermediate transfer belt 101.

In order to improve the responsiveness with respect to the various recording media, the secondary transfer unit 104 includes the secondary transfer belt 110 using a polyimide (PI) belt, a plurality of rollers 111 which stretches the secondary transfer belt 110 and is rotationally driven. The secondary transfer unit 104 collectively transfers the color toner images which are transferred onto the intermediate transfer belt 101 onto the sheet (the recording medium) 105 which is conveyed by the secondary transfer belt 110. More specifically, the secondary transfer unit 104 applies a charge (secondary transfer bias) opposite to the charge of the color toner image from the back side of the secondary transfer belt 110 which conveys the sheet 105, and allows the color toner image to be electrostatically attracted to the secondary transfer belt 110 or the sheet 105.

A regular reflection sensor 400 which is used for resist correction processing described below, is disposed in a specific position on the secondary transfer belt 110.

The fixing device 106 includes a fixing roller and a pressurizing roller. The fixing roller includes a fixing heater which is embedded therein. The front surface of the fixing roller, for example, is coated with a fluorine resin.

The fixing device 106 conveys the sheet 105 onto which an unfixed color toner image is transferred, performs fixing with respect to the color toner image by an action of pressurizing and heating, and ejects paper to the outside of the device as a printed matter.

The controller 300 is a process controller controlling an image formation engine (hardware and a process) including each of the image formation units 100, the multibeam light scanning device 202, the intermediate transfer belt 101, the primary transfer charger 103, the secondary transfer unit 104, and the fixing device 106, and is an interface controller performing input and output of a control signal and a detection signal with respect to hardware.

Next, a characteristic function of the functions which are exhibited by controller 300 will be described.

A color image forming device of a tandem system, in general, forms an image of a patch pattern (hereinafter, referred to as a "patch image") such as an oblique line or a horizontal line for detecting a shift in a main scanning direction and a sub-scanning direction of a transfer position on an intermediate transfer belt for each color. The color image forming device of the tandem system reads the interval between the respective patch images to calculate a color shift correction amount, and performs resist correction processing of correcting a color shift of each of the colors in the main scanning direction and the sub-scanning direction.

In contrast, in the printer 1 of this embodiment, in order to improve the responsiveness with respect to the various recording media (for example, uneven paper and the like), the elastic (rubber) belt is used for the intermediate transfer belt 101. In this case, regular reflection light extremely decreases on the elastic belt, and thus, in a patch image detection system using regular reflection, the secondary transfer belt 110 using a material (polyimide (PI)) from which the regular reflection light can be obtained, is also used. That is, in a case where the intermediate transfer belt (the elastic belt) 101 and the secondary transfer belt 110 are used, the printer 1 reads an edge portion of the patch image which is transferred onto the secondary transfer belt 110 from the intermediate transfer belt (the elastic belt) 101 by the regular reflection sensor 400.

In general, when a color image is transferred onto the secondary transfer belt as described above (secondary transfer), in the color image forming device of the tandem system, the patch image is transferred in optimal conditions (a transfer voltage or a transfer current) at the time of printing the color image, in consideration of superimposing color images of at least two colors.

However, there is a case where the optimal conditions as the color image are not optimal as conditions for transferring the color image onto the secondary transfer belt 110 (the secondary transfer) according to the shape or the color of the patch image. In such a case, there is a case where the transfer onto the secondary transfer belt 110 is insufficient, and a variation or a deviation occurs in an adhesion amount of a toner or an ink.

Thus, in a case where the variation or the deviation occurs in the adhesion amount, the output sensed by the regular reflection sensor 400 becomes unstable, or the phase of the output sensed by the regular reflection sensor 400 is shifted. The unstable output or the phase shift becomes an error in reading the interval between the patch images, and thus, it is not possible to detect an accurate position shift.

Therefore, in this embodiment, the controller 300 exhibits a function of reducing a detection error of the interval between the patch images on the secondary transfer belt 110 and reduces a color shift or a color matching variation. Hereinafter, this will be described in detail.

Figure 2:
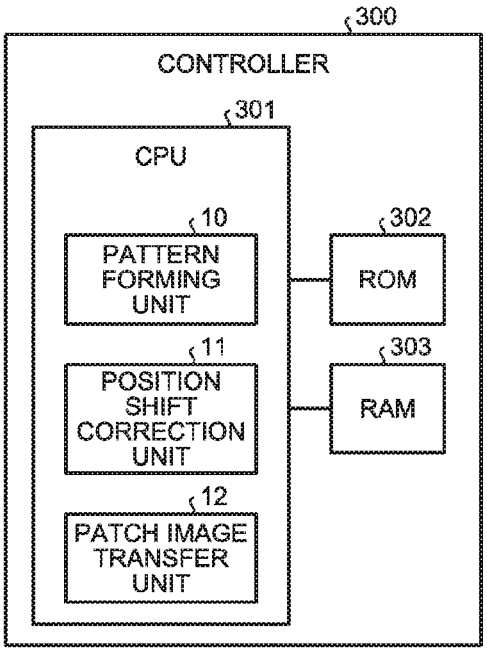
FIG. 2 is a block diagram illustrating a configuration of a controller.

FIG. 2 is a block diagram illustrating the configuration of the controller 300. The controller 300 includes a microcomputer system such as an ROM 302 in which a control program is stored, an RAM 303 which is used as a working memory, and a CPU 301 which performs control on the basis of the control program.

The control program which is executed by the printer 1 of this embodiment is recorded in a recording medium which can be read by a computer as a file in an installable format or an executable format, such as a CD-ROM, a flexible disk (FD), CD-R, and a digital versatile disk (DVD), to provide the control program.

The control program which is executed by the printer 1 of this embodiment may be configured to be stored on the computer connected to a network such as the internet, and to be download through the network to provide the control program. The control program which is executed by the printer 1 of this embodiment may be configured to be provided or distributed through the network such as the internet.

The control program which is executed by the printer 1 of this embodiment may be configured to be incorporated in advance in the ROM 302 or the like, to provide the control program.

The control program which is executed by the printer 1 of this embodiment is a module configuration including a pattern forming unit 10, a position shift correction unit 11, and a patch image transfer unit 12. In actual hardware, the CPU 301 reads the control program from the storage medium described above and executes the read control program, and thus, each of the units described above is loaded on a main storage device, and the pattern forming unit 10, the position shift correction unit 11, and the patch image transfer unit 12 are generated on the main storage device.

Formation of Toner Image Pattern for Detecting Position Shift

First, the formation of a patch group 404 (refer to FIG. 3), which is a toner image pattern for detecting a position shift (the patch image), using the pattern forming unit 10 functioning as the pattern forming unit will be described.

The pattern forming unit 10 generates a predetermined pattern of each of the colors, forms the patch group 404 by each of the image formation units 100K to 100Y, and transfers the patch group 404 onto the intermediate transfer belt 101.

The formation of the patch group 404 onto the intermediate transfer belt 101 using the pattern forming unit 10 is performed before an image forming operation with respect to the sheet 105. For example, the formation of the patch group 404 onto the intermediate transfer belt 101 is performed at the time of starting up the printer 1 (immediately after a main power source is turned on by turning on a main power source switch) or at the time of performing returning (immediately after returning is performed from an energy saving mode for power saving to a standby mode in which a printing operation can be performed).

The formation of the patch group 404 using the pattern forming unit 10 and the calculation of a correction amount based on the patch group 404 of the position shift correction unit 11 described below are performed as a set of operations. It is also preferable that the set of operations is performed in a case where a temperature detection unit (included in the printer 1) detects a temperature change of greater than or equal to a predetermined value, in a case where a timer (included in the printer 1) detects the elapse of a predetermined time, or a case where a counter (included in the printer 1) prints a predetermined number of sheets. The pattern forming unit 10 forms the patch group 404 between the sheets, that is, between the sheet 105 and the sheet 105 without stopping the printing operation at the time of detecting a predetermined number of sheets by the temperature, the timer, or the counter.

Here, the patch group 404 will be described.

Figure 3:
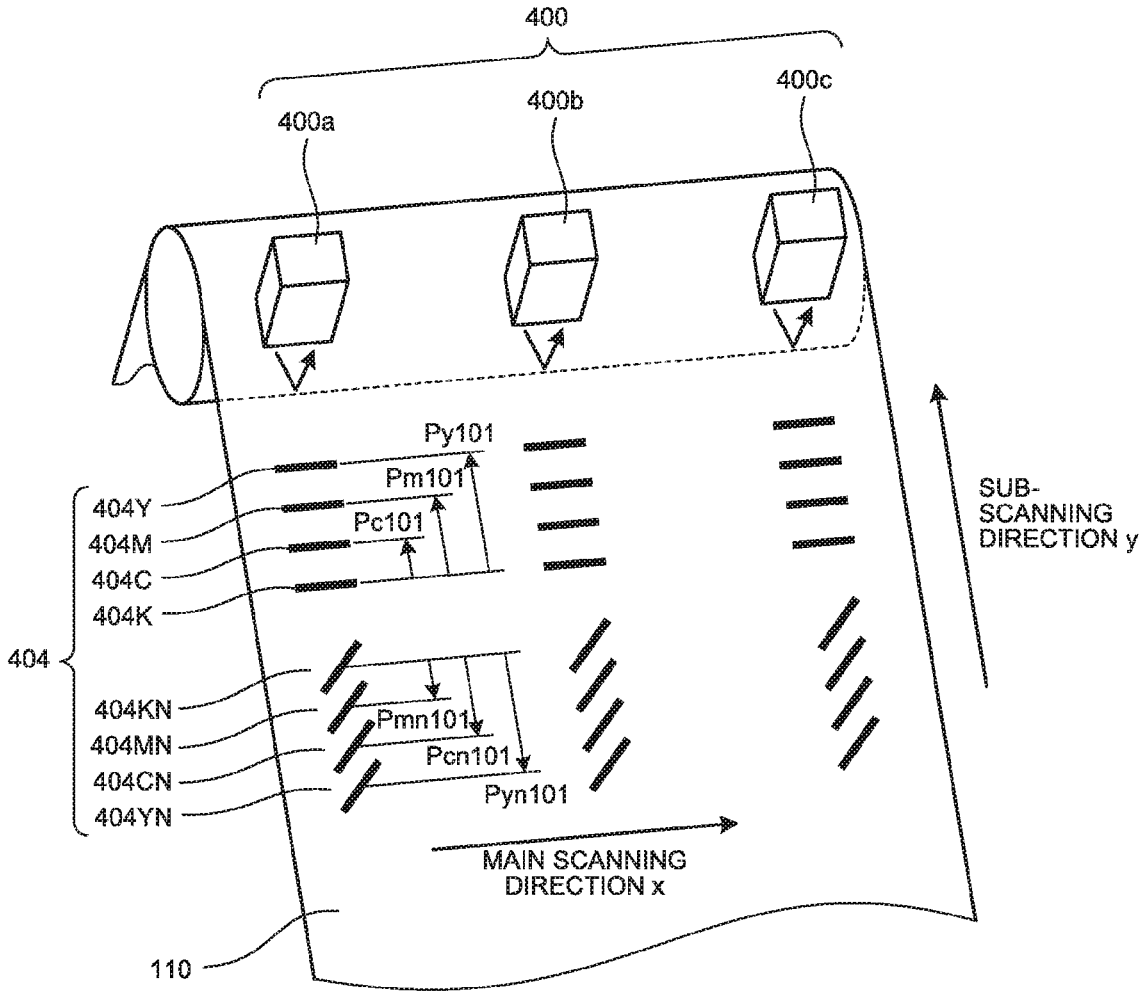
FIG. 3 is a perspective view illustrating a patch group which is formed on a secondary transfer belt.

FIG. 3 is a perspective view illustrating the patch group 404 which is formed on the secondary transfer belt 110. As illustrated in FIG. 3, the patch group 404 between the sheets 105 is formed by four colors of cyan (C), magenta (M), yellow (Y), and black (K). In the patch group 404, horizontal line patches (404Y, 404M, 404C, and 404K) which are four parallel patterns, and oblique line patches (404KN, 404MN, 404CN, and 404YN) which are four oblique lines, are arranged in the sub-scanning direction y at regular intervals.

The patch group 404 is formed such that the patch group 404 is divided into three portions in the main scanning direction (the movement direction of the secondary transfer belt 110) x. The patch images on both ends in the main scanning direction x are formed on both ends of a writing region, and the remaining one portion is formed in the center portion of the writing region. Here, the writing region is a range in which a toner image can be transferred onto the sheet 105.

As illustrated in FIG. 3, the regular reflection sensor 400 also includes three regular reflection sensors 400*a* to 400*c* according to the patch group 404.

A light emitting element and a light receiving element are provided in each of the regular reflection sensors 400*a* to 400*c*. That is, the regular reflection sensors 400*a* to 400*c* receive light of the light emitting element which is reflected on the secondary transfer belt 110 by the light receiving element.

The patch image (the patch group 404) which is detected on the secondary transfer belt 110 by the regular reflection sensor 400 is removed by a cleaner.

[Secondary Transfer of Patch Image]

Next, the transfer of the patch group 404 formed on the intermediate transfer belt 101 onto the secondary transfer belt 110 by controlling a current value (a secondary transfer current value) of the secondary transfer bias with the patch image transfer unit 12 functioning as the patch image transfer unit, will be described.

The patch group 404 formed on the intermediate transfer belt 101 is a linear line drawing pattern. Therefore, as illustrated in FIG. 3, the patch group 404 which is transferred onto the secondary transfer belt 110 by the secondary transfer unit 104 is also a linear line drawing pattern. Each patch of the line drawing pattern configuring the patch group 404 has to be transferred onto the secondary transfer belt 110 for each of the colors without any position shift.

In contrast, in the formation of a full color image, in order to control the adhesion amount of the toner in consideration of color superimposition or the like, there is tendency that a transfer voltage and a transfer current flows compared to a case where an image of a single color (at the time of performing monochrome printing) is formed.

Figure 4:
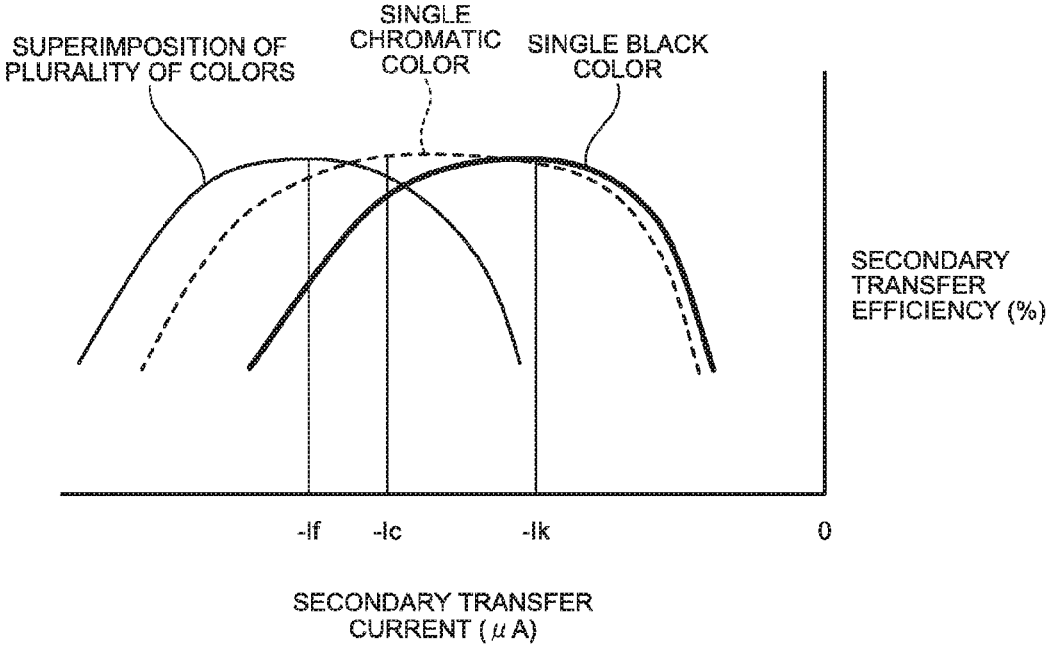
FIG. 4 is a graph illustrating a relationship between a secondary transfer current and a secondary transfer efficiency for each color or at the time of superimposing a plurality of colors.

Here, FIG. 4 is a graph illustrating a relationship between a secondary transfer current and a secondary transfer efficiency for each of the colors or at the time of superimposing a plurality of colors. The graph illustrated in FIG. 4 illustrates test result of the relationship between the secondary transfer current and the secondary transfer efficiency under a certain environment. The graph illustrated in FIG. 4 illustrates the secondary transfer current on a horizontal axis and the secondary transfer efficiency on a vertical axis. In FIG. 4, a secondary transfer current value −Ik having the most excellent transfer efficiency in a single black color, a secondary transfer current value −Ic having the most excellent transfer efficiency in a single chromatic color, and a secondary transfer current value −If having the most excellent transfer efficiency in the superimposition of a plurality of colors, are illustrated.

As illustrated in FIG. 4, the transfer current having the most excellent transfer efficiency is different according to each of the colors or the color superimposition. For this reason, in a case where the transfer current is set to the transfer current (−If) of the superimposition of a plurality of colors at the time of forming the patch group 404 in a full color image, the transfer efficiency of the single black color with respect to the patch images 404K and 404KN of the single black color decreases, and thus, a toner concentration distribution of a line width having thin line drawing is in a state of being biased to a sub-direction.

Therefore, in this embodiment, when the patch images 404K and 404KN of the single black color are formed between the sheets 105 on the secondary transfer belt 110, the patch image transfer unit 12, in particular, performs the transfer under transfer conditions where the line drawing adheres evenly. As illustrated in FIG. 4, the transfer efficiency with respect to the transfer current is comparatively stable in the single chromatic color, whereas a transfer current range having an excellent transfer efficiency is narrow (the band of the transfer efficiency is narrow) in the single black color at the time of performing the monochrome printing, and thus, it is preferable to set a transfer current setting value having an excellent transfer efficiency with respect to the single black color. Accordingly, it is possible to increase a transfer position accuracy of a black color, which is a reference color. It is possible to increase a transfer position accuracy of the line drawing.

That is, the transfer efficiency with respect to the transfer current is comparatively stable in the single chromatic color, and thus, in a case where the black or colored patch group 404 is formed in secondary transfer conditions at the time of performing the transfer in a black toner image, it is possible to evenly form the patch image.

However, in order to evenly transfer the patch group 404 between the sheets 105 on the secondary transfer belt 110, it is necessary for the patch image transfer unit 12 to decrease the transfer current to an optimal transfer current. However, it takes time to switch the secondary transfer current. Therefore, when a transition is performed to the transfer conditions (−Ik) of the black color from the other transfer conditions (−If) and when the transition is performed to the transfer conditions (−Ik) of the black color from the other transfer conditions (−If), the patch image transfer unit 12 forms a colored patch, and forms a patch of a black toner in a position in which the switching to the transfer conditions (−Ik) of the black color is completed (refer to (d) in FIG. 6). Accordingly, it is possible to form the patch group 404 in a minimum inter-sheet distance.

The patch image transfer unit 12 determines the secondary transfer conditions as described above, and thus, it is possible to accurately transfer and form the patch group 404 onto the secondary transfer belt 110 and to minimally suppress the detection error. Therefore, it is possible to obtain an excellent result of position shift calculation.

However, in the secondary transfer belt 110, it is known that a resistance value of the belt is changed according to the environment (a temperature, humidity, and the like). For example, in a case of a high temperature and high humidity environment, the secondary transfer belt 110 is humidified, the resistance value decreases, and the current tends to decrease. For this reason, it is necessary for the patch image transfer unit 12 to determine the optimal secondary transfer voltage and the secondary transfer current at the time of forming the patch image according to environment conditions.

Figure 5:
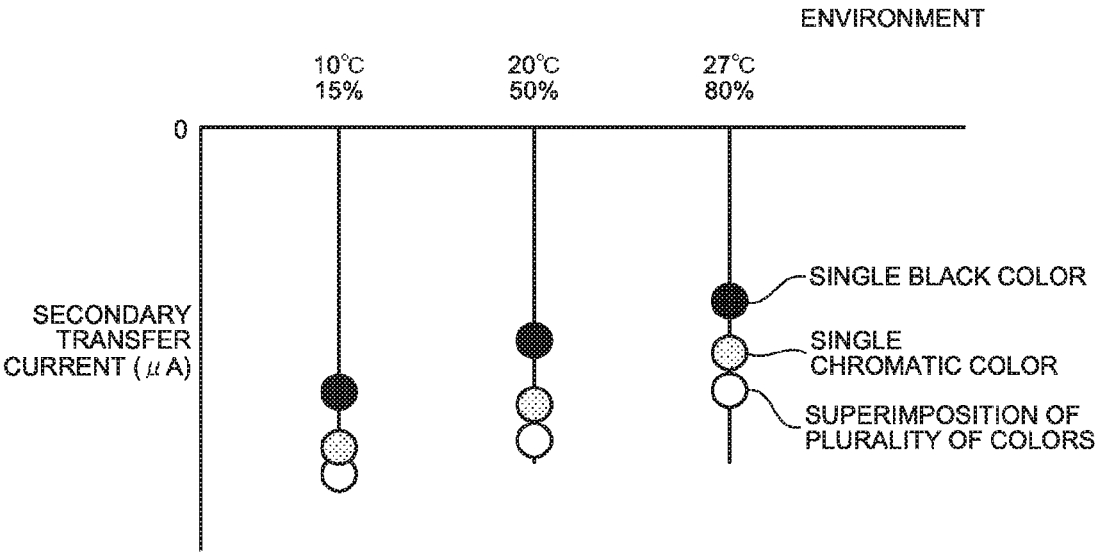
FIG. 5 is a schematic diagram illustrating a relationship between environment and the secondary transfer current for each color or at the time of superimposing a plurality of colors.

Here, FIG. 5 is a schematic diagram illustrating a relationship between an environment and the secondary transfer current for each of the colors or at the time of superimposing a plurality of colors. In FIG. 5, the outline of a change in the secondary transfer current having the most excellent transfer efficiency according to the environment is illustrated. Thus, the patch image transfer unit 12 changes the optimal secondary transfer voltage and the optimal secondary transfer current at the time of forming the patch image according to the environment conditions, and thus, even in a case where the environment is changed, it is possible to maintain a stable transfer efficiency. Therefore, it is possible to increase the transfer position accuracy.

As described above, the patch image transfer unit 12 controls the transfer of the patch group 404 onto the secondary transfer belt 110 as described above. Accordingly, it is possible to form the patch image in a position where the secondary transfer is stable, to minimally suppress the detection error in the minimum inter-sheet distance, and to obtain an excellent result of the position shift calculation.

In this embodiment, the transfer conditions have been described as the secondary transfer current of constant current driving, but the secondary transfer current may be replaced with a voltage. For example, −Ik has been set, but −Vk may be set.

Control of Position Shift Correction Using Regular Reflection Light

Next, the control of the position shift correction using the position shift correction unit 11 functioning as the position shift correction unit will be described. The position shift correction unit 11 detects the patch group 404 which is transferred onto the secondary transfer belt 110 by the regular reflection sensor 400, and corrects the position shift of each of the colors in the main scanning direction and the sub-scanning direction.

In this embodiment, an adjustment value of the skew on a scanning line and an adjustment value of a scanning width are determined using the patch group 404 of three portions in the writing region, in addition to a resist adjustment value in the main scanning direction x and the sub-scanning direction y.

The position shift correction unit 11 calculates a distance between specific colors from position information obtained by detecting the patch group 404 formed on the secondary transfer belt 110 by the regular reflection sensor 400, and corrects the position shift.

More specifically, as illustrated in FIG. 3, the position shift correction unit 11 executes resist positioning in the sub-scanning direction y from the horizontal line patches 404K to 404Y, and executes resist positioning in the main scanning direction x from a difference in time intervals between the horizontal line patches 404K to 404Y and the oblique line patches 404KN to 404YN. For example, the position shift correction unit 11 measures the time interval of each of the detection signal of the horizontal line patch 404K of the reference color (here, black K) and the detection signals of the horizontal line patches 404Y, 404M, and 404C of each of the other colors (Y, M, and C).

Figure 6:
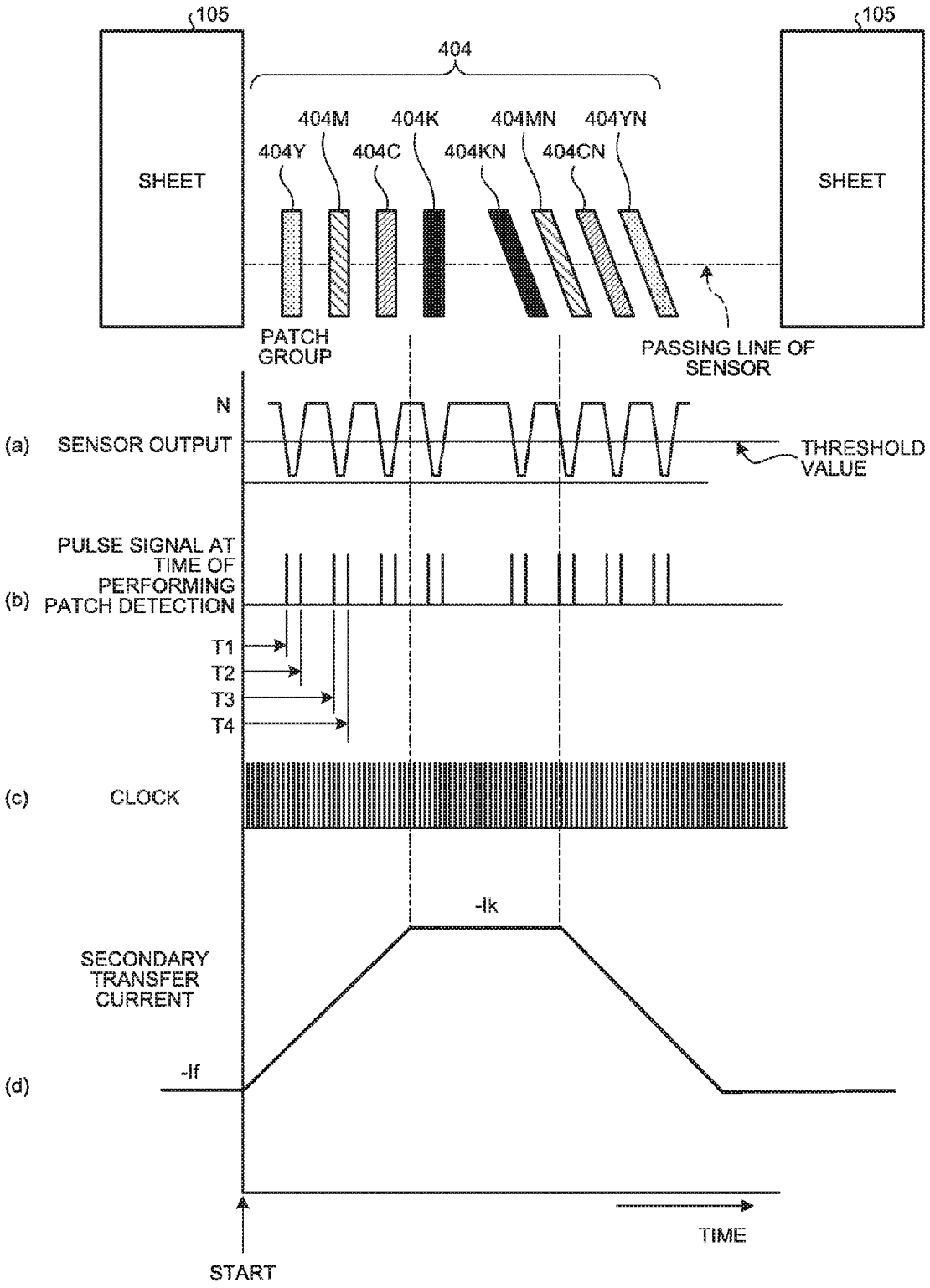
FIG. 6 is a timing chart illustrating various signals at the time of performing patch detection in a regular reflection sensor.

Here, FIG. 6 is a timing chart illustrating various signals at the time of performing patch detection in the regular reflection sensor 400. As illustrated at (a) in FIG. 6, the regular reflection sensor 400 outputs the detection signal corresponding to the patch according to a change in the amount of received light of the light receiving element which corresponds to the patch group 404 on the secondary transfer belt 110.

In a case where the detection signal corresponding to the patch, which is output from the regular reflection sensor 400, becomes a threshold value level, as illustrated at (b) in FIG. 6, the position shift correction unit 11 outputs a pulse signal at the time of performing the patch detection.

Then, as illustrated at (c) in FIG. 6, the position shift correction unit 11 counts the number of clocks from a predetermined start (START) position after the end of the image to a pulse at the time of performing the patch detection. The position shift correction unit 11 calculates a time from the number of clocks up to the pulse at the time of performing the patch detection, and as illustrated at (b) in FIG. 6, obtains a measurement result of times T1, T2 . . . at the time of performing the patch detection.

The position shift correction unit 11 obtains a center position at the time of performing the patch detection from the measurement result described above. Specifically, the position shift correction unit 11 obtains the value of a center position of TY=(T1+T2)/2 at the time of performing the patch detection in the horizontal line patch 404Y, and obtains the value of a center position TM=(T3+T4)/2 at the time of performing the patch detection in the horizontal line patch 404M. Similarly, the position shift correction unit 11 also calculates center positions TC and TK at the time of performing the patch detection in the horizontal line patch 404C and the horizontal line patch 404K. Then, the position shift correction unit 11 calculates relative temporal differences Py, Pm, and Pc (refer to FIG. 3), which are patch intervals in the horizontal line patches 404Y, 404M, and 404C with respect to the horizontal line patch 404K. More specifically, Py101=(TK−TY), Pm101=(TK−TM), and Pc101=(TK−TC) are obtained.

Then, the position shift correction unit 11 controls a sub-scanning position (a position in a circumferential direction) of the laser light which exits from the multibeam light scanning device 202 to expose the photoconductor drum 200 with respect to the photoconductor drum 200, by the measured relative temporal difference.

That is, the position shift correction unit 11 controls an exiting position of the laser light exiting from the multibeam light scanning device 202, and sets the relative temporal difference to a targeted relative temporal difference. That is, the position shift correction unit 11 matches an image formation positions of the other colors of M, C, and Y to be at targeted pitch intervals from an image formation position of the black K with respect to the secondary transfer belt 110.

In this embodiment, the patch image is formed once, but the present invention is not limited thereto. In general, an error at the time of performing measurement occurs due to a mechanical speed variation factor, and thus, the same patch group 404 may be formed a plurality of times between a plurality of sheets in the sub-direction, the resist adjustment value may be calculated by the same method as described above, and the average value thereof may be calculated. Thus, it is possible to decrease a mechanical periodic error.

In this embodiment, the patch group 404 is formed in three portions in the main scanning direction, but even in a case where the patch group 404 is formed in two portions of both ends, it is possible to determine the same adjustment value. For example, in a case where the patch group 404 is formed in only one portion on one side, only the resist adjustment value is determined.

Thus, according to this embodiment, the patch image transfer unit 12 transfers the patches of at least single color (the black color) for which the band of the transfer efficiency is narrowest, of the patch group, onto the secondary transfer belt 110 under the transfer conditions for the color for which the band is narrow. Accordingly, it is possible to generate a black patch group under the transfer conditions (the secondary transfer voltage or the secondary transfer current) having the most excellent transfer efficiency in the single black color, and thus, it is possible to reduce a variation in the adhesion amount or a transfer position shift of the patch image, and to prevent the position shift adjustment value which is obtained from a plurality of patch groups from being affected. That is, it is possible to increase the accuracy of the color shift correction, and to obtain an excellent color image having a small color shift or a small color matching variation.

According to this embodiment, when a transition is performed to the transfer conditions for the color (the black color) for which the band is narrow, from the other transfer conditions and when the transition is performed to the other transfer conditions from the transfer conditions for the color (the black color) for which the band is narrow, the patch image transfer unit 12 transfers the patch of the patch group of the color (the colored color) other than the color for which the band is narrow, onto the secondary transfer belt 110. Accordingly, it is possible to form the patch of the reference color (black) after the transition is performed to the transfer conditions having the most excellent transfer efficiency in the single color, and to form the patch of the color image in the middle of performing the transition with respect to the transfer conditions.

In the embodiments described above, the image forming device of the present invention has been described using an example in which the image forming device is applied to the color laser printer of the tandem system based on an electrophotography system, but the present invention is not limited thereto. For example, insofar as the image forming device is a color image forming device having at least two functions of a copy function, a printer function, a scanner function, and a facsimile function, such as a multifunction peripheral, a copying machine, and a facsimile machine, the image forming device can be applied to any application.

According to an embodiment, an effect that the detection error of the interval between the patch images on the secondary transfer belt can be reduced and an excellent color image having a small color shift or a small color matching variation can be obtained, is achieved.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming device comprising:

a plurality of image formation units each configured to form an image of one of a plurality of colors;

an intermediate transfer belt configured such that images of the plurality of colors formed by the image formation units are transferred onto the intermediate transfer belt such that the images are superimposed;

a secondary transfer belt configured to convey a recording medium onto which the images of the plurality of colors formed on the intermediate transfer belt are to be collectively transferred;

a reflection sensor configured to receive reflection light with respect to the secondary transfer belt;

a pattern forming unit configured to form a patch group which is a pattern for detecting a position shift and includes a plurality of patches arranged at regular intervals, with the image formation units, and transfer the patch group onto the intermediate transfer belt;

a patch image transfer unit configured to control transfer conditions relating to transfer bias during transferring the patch group formed on the intermediate transfer belt onto the secondary transfer belt; and a position shift correction unit configured to detect the patch group transferred onto the secondary transfer belt with the reflection sensor, and correct position shifts in each of the plurality of colors in a main scanning direction and a sub-scanning direction, wherein the patch image transfer unit is configured to transfer patches of at least single color for which a band of transfer efficiency is narrowest, of the patch group, onto the secondary transfer belt under transfer conditions for the color for which the band is narrow, and during transition to the transfer conditions for the color for which the band is narrow, from other transfer conditions or during transition from the transfer conditions for the color for which the band is narrow, to the other transfer conditions, patches of a color other than the color for which the band is narrow, of the patch group is transferred onto the secondary transfer belt.

2. The image forming device according to claim 1, wherein the patch image transfer unit is configured to make transition to the transfer conditions for the color for which the band is narrow, from the other transfer conditions, and transition to the other transfer conditions from the transfer conditions for the color for which the band is narrow, between recording media which are conveyed by the secondary transfer belt.

3. The image forming device according to claim 1, wherein the patch image transfer unit is configured to set the transfer conditions for the color for which the band is narrow, to transfer conditions for a black toner during monochrome printing.

4. The image forming device according to claim 3, wherein the patch image transfer unit is configured to set the transfer conditions for the color for which the band is narrow, to transfer conditions under which a line drawing adheres evenly.

5. The image forming device according to claim 1, wherein the patch image transfer unit is configured to change the transfer conditions for the color for which the band is narrow, according to environment conditions.

6. A position shift correction method executed by an image forming device including a plurality of image formation units each configured to form an image of one of a plurality of colors, an intermediate transfer belt configured such that images of the plurality of colors formed by the image formation units are transferred onto the intermediate transfer belt such that the images are superimposed, a secondary transfer belt configured to convey a recording medium onto which the images of the plurality of colors formed on the intermediate transfer belt are to be collectively transferred, and a reflection sensor configured to receive reflection light with respect to the secondary transfer belt, the method comprising:

forming a patch group which is a pattern for detecting a position shift and includes a plurality of patches arranged at regular intervals, with the image formation units, and transferring the patch group onto the intermediate transfer belt;

controlling transfer conditions relating to transfer bias during transferring the patch group formed on the intermediate transfer belt onto the secondary transfer belt; and detecting the patch group transferred onto the secondary transfer belt with the reflection sensor, and correcting position shifts in each of the plurality of colors in a main scanning direction and a sub-scanning direction, wherein at the controlling of the transfer conditions, patches of at least single color for which a band of a transfer efficiency is narrowest, of the patch group, is transferred onto the secondary transfer belt under transfer conditions for the color for which the band is narrow, and during transition to the transfer conditions for the color for which the band is narrow, from other transfer conditions or during transition from the transfer conditions for the color for which the band is narrow, to the other transfer conditions, patches of a color other than the color for which the band is narrow, of the patch group, is transferred onto the secondary transfer belt.

7. A non-transitory computer-readable recording medium including programmed instructions that cause a computer configured to control an image forming device including a plurality of image formation units each configured to form an image of one of a plurality of colors, an intermediate transfer belt configured such that the images of the plurality of colors formed by the image formation units are transferred onto the intermediate transfer belt such that the images are superimposed, a secondary transfer belt configured to convey a recording medium onto which the images of the plurality of colors formed on the intermediate transfer belt are to be collectively transferred, and a reflection sensor configured to receive reflection light with respect to the secondary transfer belt, to function as:

a pattern forming unit configured to form a patch group which is a pattern for detecting a position shift and includes a plurality of patches arranged at regular intervals, with the image formation units, and transfer the patch group onto the intermediate transfer belt;

a patch image transfer unit configured to control transfer conditions relating to transfer bias during transferring the patch group formed on the intermediate transfer belt onto the secondary transfer belt; and a position shift correction unit configured to detect the patch group transferred onto the secondary transfer belt with the reflection sensor, and correct position shifts in each of the colors in a main scanning direction and a sub-scanning direction, wherein the patch image transfer unit is configured to transfer patches of at least single color for which a band of a transfer efficiency is narrowest, of the patch group, onto the secondary transfer belt under transfer conditions for the color for which the band is narrow, and during transition to the transfer conditions for the color for which the band is narrow, from other transfer conditions or during transition from the transfer conditions for the color for which the band is narrow, to the other transfer conditions, patches of a color other than the color for which the band is narrow, of the patch group, is transferred onto the secondary transfer belt.

* * * * *